United States Patent [19]

Suzuki

[11] Patent Number: 4,674,653

[45] Date of Patent: Jun. 23, 1987

[54] ARTICLE STORAGE AND DISPENSING DEVICE WITH SOLD OUT INDICATING MECHANISM

[75] Inventor: Kazuyuki Suzuki, Ota, Japan

[73] Assignee: Sanden Corporation, Gunma, Japan

[21] Appl. No.: 738,861

[22] Filed: May 29, 1985

[30] Foreign Application Priority Data

May 29, 1984 [JP] Japan ..... 59-77922

[51] Int. Cl.[4] ..... G07F 9/02

[52] U.S. Cl. ..... 221/6; 221/75

[58] Field of Search ..... 221/75, 6, 14

[56] References Cited

U.S. PATENT DOCUMENTS

| | | | |
|---|---|---|---|
| 2,564,552 | 8/1951 | Verdery | 221/75 |
| 3,335,907 | 8/1967 | Holstein et al. | 221/75 X |
| 4,149,653 | 4/1979 | Lennartson | 221/75 |

*Primary Examiner*—F. J. Bartuska

*Attorney, Agent, or Firm*—Banner, Birch, McKie & Beckett

[57] ABSTRACT

A sold out detector for an article storage and dispensing device includes a detecting plate which is pivotally supported on the device and normally pushed toward one side plate of the device by the stored articles and an empty switch controlled by the movements of the detecting plate. A movable element extends within the clearance between the side plate and the detecting plate to contact with the plates. The movable element is operatively connected with a drive source to enable the rotating motion of the drive source to transmit movement to the detecting plate through the movable element. As a result, frozen water which tends to fill the gap between the side plate of the device and the detecting plate easily falls away.

7 Claims, 5 Drawing Figures

ARTICLE STORAGE AND DISPENSING DEVICE WITH SOLD OUT INDICATING MECHANISM

BACKGROUND OF THE INVENTION

This invention relates to an article storage and dispensing device for refrigerated articles from a vending machine, and more particularly, to a primary device for detecting a sold out situation of the stored articles which is suitable for use in a helix-type storage and dispensing device.

Helix-type article storage and dispensing devices are well known in the prior art. For example, U.S. Pat. No. 3,335,907 issued to Holstein et al. discloses a transversely disposed helix-type dispensing device. In this dispensing device, an article storage cabinet has a discharge opening in one side plate and helical element transversely extending within the cabinet. One end of the helical element is connected to a driving device to cause rotating motion of the element. During rotating motion of the helical element, the articles stored in the gaps between the spirals of the helical element are moved toward the discharge opening and the most outwardly positioned article is discharged through the discharge opening. In this construction of an article dispensing device, means for detecting an empty situation of the stored articles is normally provided on the device to stop the vending mechanism and indicate the empty situation to customers. One basic construction of a detecting device is disclosed in U.S. Pat. No. 2,564,552 issued to H. Verdery.

Referring to FIG. 1, the basic construction of a prior art detecting device is disclosed. The storage space S formed in cabinet 1 extends vertically and a helical element 2 is disposed within cabinet 1 to extend vertically. Cabinet 1 has an article loading opening 3 in the front plate 1*a* which is normally closed by a door 4, and a discharge opening at its lower end to discharge the articles. The upper end of helical element 2 is connected to the driving means (not shown) disposed on the upper plate of cabinet 1 through a coupling device 5 connected to the driving means by pin 6. A detecting plate 7 is pivotally supported in cabinet 1 extending within the storage area S of cabinet 1. Generally, detecting plate 7 is pushed toward the rear plate 1*b* of cabinet 1 by the stored articles A but if all of the stored articles have been dispensed and the cabinet is empty, detecting plate 7 swings in close to helical element 2, this position being indicated by number 7' in FIG. 1.

Therefore, if a microswitch or other switch element is mounted on the rear plate 1*b* of cabinet 1 in contact with detecting plate 7, the empty situation of stored articles is easily detected by the movement of detecting plate 7. The general construction and operation of an empty switch is disclosed in U.S. Pat. No. 2,564,552.

If the above mentioned article storage and dispensing device is used in a refrigerated article vending machine, the drops of water caused by condensation while door 4 is opened to load the articles adhere to or condense on the inner surface of rear plate 1*b*. As the refrigerating operation continues to maintain the predetermined temperature in storage space S, the water of condensation fills the gap between rear plate 1*b* and detecting plate 7, cools down and finally freezes. As a result of the buildup of the frozen water droplets, detecting plate 7 becomes rigidly affixed on the rear plate 1*b* due to the frozen drops of water. Thus, even if the stored articles are all dispensed and the dispensing device has no articles left therein, the vending machine is still held in the operating condition. Thus, the customers cannot recognize the empty situation.

A prior detecting device construction has been explained with reference to one type of helix-type dispensing device. However, as shown in FIG. 2, this detecting device can be used not only with a single stored row dispensing device but also with a plural stored row dispensing device. Also, if the dispensing device has plural stored rows, plural detecting devices may be disposed in the cabinet facing each of the rows, respectively.

SUMMARY OF THE INVENTION

It is a primary object of this invention to provide an improved article storage and dispensing device with a detecting device effectively operable for sensing an empty situation as to the stored articles.

It is another object of this invention to provide an article storage and dispensing device wherein the detecting device operates smoothly without being influenced by the external environment.

It is still another object of this invention to accomplish the above objects with a simple form of construction.

A helix-type article storage and dispensing device according to this invention includes a cabinet having an article loading opening and an article discharge opening. A helical element is disposed extending vertically within the cabinet and the upper end of the helical element is connected to a driving means to enable application of rotating motion to effect successive discharging of the articles. A sold out detecting plate is pivotally supported in the cabinet for detecting an empty situation with respect to the stored articles. This plate normally contacts with the stored articles to be held against the rear plate of the cabinet. A movable element extends vertically within the cabinet disposed within the gap between the rear plate and the detecting plate. This movable element is rotatably supported on the cabinet. The movable element is operatively connected to the driving means to cause swinging motion due to operation of the driving means.

Further objects, features, and other aspects of this invention will be understood from the following detailed description of preferred embodiments of this invention with reference to the annexed drawings.

DETAILED DESCRIPTION OF THE PREFERRED EMBODIMENTS

Figure 3:
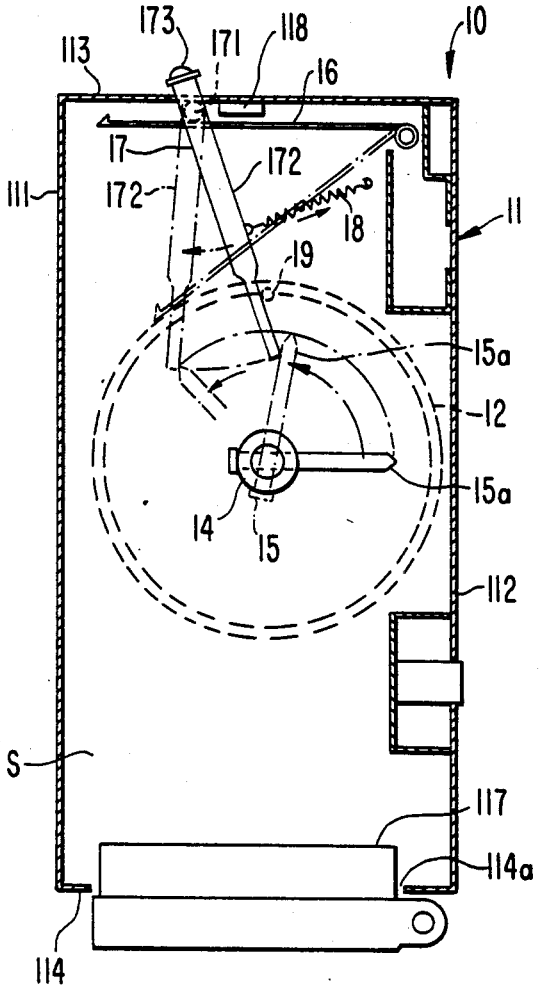
FIG. 3 is a horizontal sectional view of a helix-type dispensing device according to one embodiment of this invention.
Figure 4:
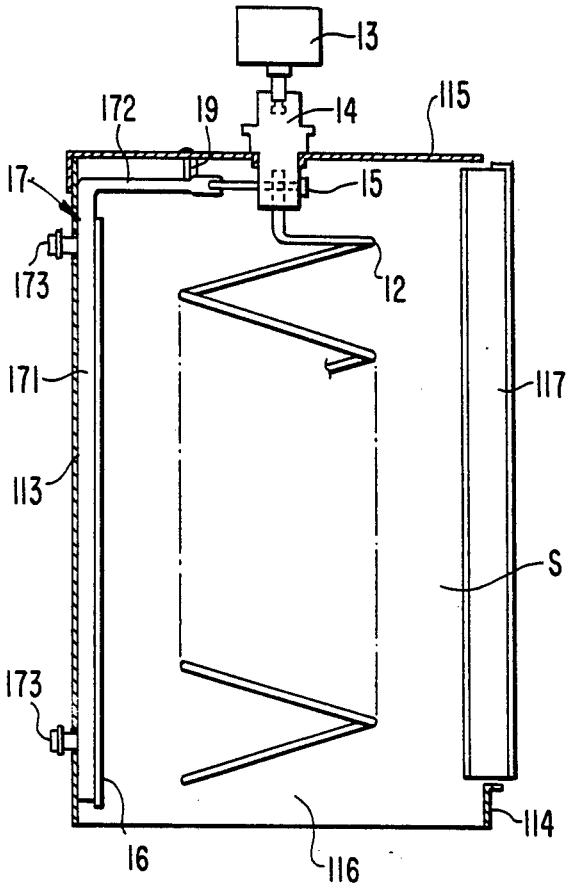
FIG. 4 is a vertical sectional view of the helix-type dispensing device shown in FIG. 3.

Referring to FIGS. 3 and 4, an article storage and dispensing device 10 according to one embodiment of this invention is shown. The article storage and dispensing device 10 comprises a cabinet 11 which is composed of left and right side plates 111 and 112, rear plate 113, front plate 114, top plate 115 and lower opening 116. A storage space "S" is thus defined within these plates. Front plate 114 is provided with an opening 114*a* for loading the articles into device 10. Opening 114*a* is usually closed by a door 117 which is hingedly supported on cabinet 11.

A helical element or coil rod 12 is disposed to extend vertically within cabinet 11. Helical element 12 forms a continuous spiral surface on which the articles are supported. The upper end of helical element 12 is coupled with a drive source, such as motor 13, which is mounted on top plate 115, by means of a coupling element 14 to impart rotating motion to element 12. The connection between helical element 12 and coupling element 14 is effected by a connecting pin 15.

A "sold out" detecting plate 16 extends vertically within the storage area "S" of cabinet 11 and is pivotally supported on cabinet 11. If articles are stored in device 10, detecting plate 16 is held toward the inner surface of rear plate 113 to be closely spaced from plate 113. On the other hand, if the articles which are normally stored in device 10 become sold out, detecting plate 16 becomes closely positioned to the face of helical element 12 (this position of plate 16 is shown by dotted lines in FIG. 3).

As mentioned above, the pivoted position of detecting plate 16 depends on the article storage situation. Therefore, if an electrical switch element, for example a microswitch 118 is mounted on rear plate 113 for control by the operated position of the detecting plate 16, an empty situation of articles is easily detected and indicated to the customer.

An L-shaped movable element 17 which comprises a vertical rod portion 171 and a horizontal rod portion 172 is disposed within storage area "S" of cabinet 11. Vertical rod portion 171 extends vertically along the inner surface of rear plate 113 and is swingably supported on rear plate 113 through supporting stub shafts 173. Supporting shafts 173 project horizontally from rod portion 171 and extend loosely through rectangular holes formed through the rear plate 113. Thus, these shafts 173 permit swinging motion of vertical rod portion 171. Horizontal rod portion 172 extends along the underside inner surface of top plate 115 but spaced from the surface. Rod portion 172 is biased toward the right side as seen in FIG. 3 by a spring element 18. The right side limit position of horizontal rod portion 172 is defined by a stopper element 19 mounted on and projecting down from the top plate 115.

One terminal end 15*a* of connecting pin 15 projects to engage with the outer end of horizontal rod portion 172 while the rotating motion of helical element 12 takes place. Therefore, rotating motion caused by motor 13 imparts movement to movable element 17 through end 15*a* of connecting pin 15 coming into contact with element 17.

In operation, motor 13 is energized by the signal to dispense an article coming from the vending machine. With motor 13 in operation, helical element 12 is rotated to feed the articles downward within the cabinet 11. At this time, detecting plate 16 is held close to the rear plate 113 by the presence of stored articles and plate 16 contacts with the vertical rod portion 171 of movable element 17. Horizontal rod portion 172 of movable element 17 contacts with the stopper element 19 due to the biasing force of spring element 18.

During the rotation of motor 13, the outer terminal end 15*a* of connecting pin 15 comes into contact with the outer end of horizontal rod portion 172 thereby pushing horizontal rod portion 172 toward the left side in FIG. 3 in opposition to spring element 18. Since the connecting pin 15 is rotated in a circle in accordance with the rotating motion of motor 13, contact between connecting pin 15 and rod portion 172 ends after a predetermined angle of rotation has occurred (this position of rod portion 172 is shown by dot and dash lines in FIG. 3). After contact between connecting pin 15 and rod portion 172 has passed, rod portion 172 returns to its previous position due to the biasing force of spring element 18.

Figure 1:
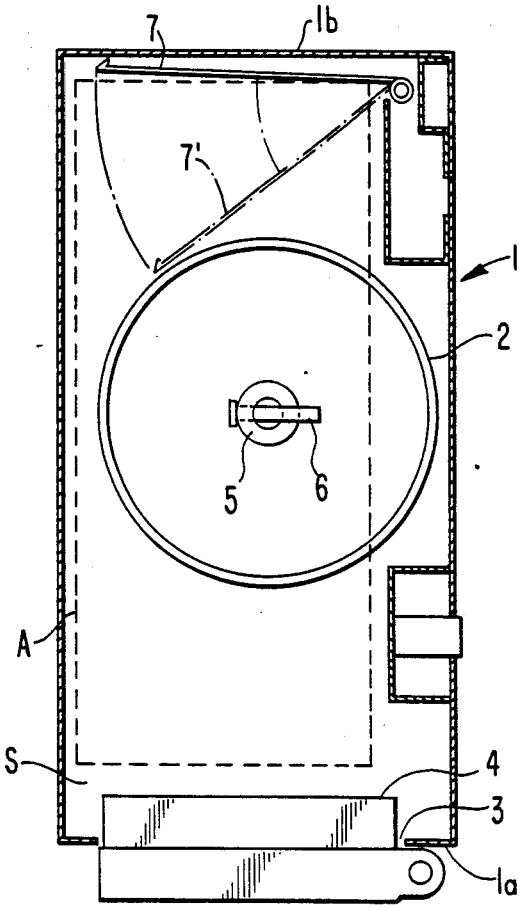
FIG. 1 PRIOR ART
FIG. 1 is a horizontal sectional view of a prior art helix-type dispensing device.
Figure 2:
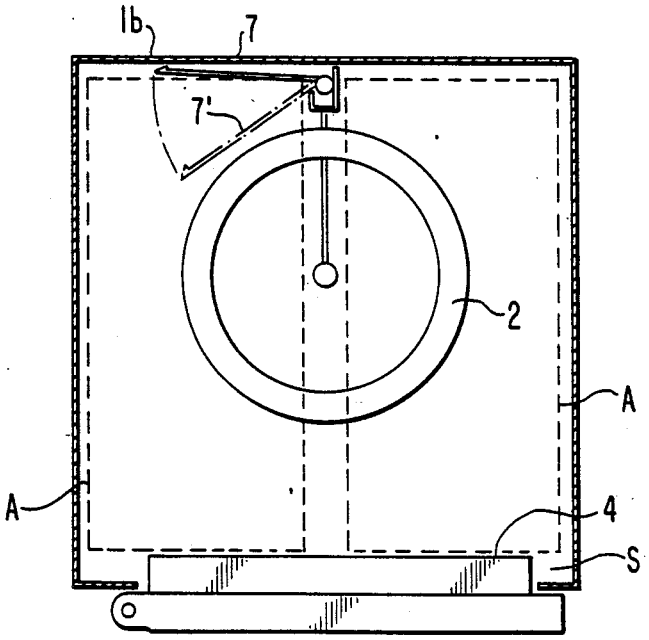
FIG. 2 PRIOR ART
FIG. 2 is a horizontal sectional view of another prior art helix-type dispensing device.

The article storage and dispensing device of this embodiment has a single storage row so that the lowermost article is dispensed by 360° of rotation of the helical element 12. Therefore, the outer terminal end 15*a* of connecting pin 15 returns to its original position after rotating 360 degrees. The horizontal rod portion 172 is thus contacted by connecting pin 15 each 360° of rotation of helical element 12. However, if the article storage and dispensing device has two storage rows of the type shown in FIG. 2, the lowermost article in the respective rows is discharged with each 180° of rotation of helical element 12. In this construction of a dispensing device, if both ends of connecting pin 15 are extended to enable contact with horizontal rod portion, the horizontal rod portion 172 can be moved by either end of connecting pin 15 with respect to each dispensing operation.

Since vertical rod portion 171 is formed integral with horizontal rod portion 172, vertical rod portion 171 partially rotates during each arc of movement of horizontal rod portion 172. As a result of these rotating movements of vertical rod portion 171, detecting plate 16 is also moved. Therefore, even if there is a buildup of frozen water tending to fill the gap between detecting plate 16 and rear plate 113, this frozen water falls free from the surfaces of the plates and detecting plate 16 remains free to perform its intended function to sense a "sold out" condition within dispensing cabinet 11.

Figure 5:
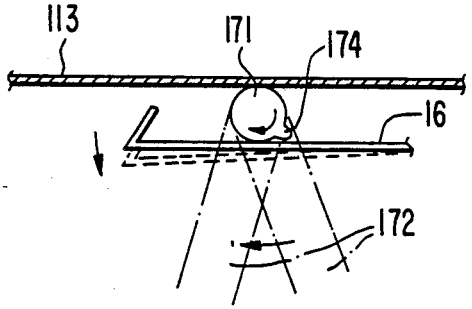
FIG. 5 is an enlarged sectional detail view illustrating the relationship between the detecting plate and the movable element according to another embodiment of this invention.

As shown in FIG. 5, one or more projections 174 can be formed on vertical rod portion 171 to contact with detecting plate 16 during the rotating movements of the vertical rod portion 171. With the swinging motion of projection 174 taking place, detecting plate 16 is essentially vibrated. Therefore, falling off of the frozen water from plates 113 and 16 is more effectively carried out.

While the rotating motion of the motor 13 is transmitted to horizontal rod portion 172 through connecting pin 15 in the disclosed embodiment, this connecting pin could be replaced by a projection formed as part of the coupling member to make for easier assembly of the dispensing device.

This invention has been described in detail in connection with the preferred embodiments, but these are examples only and this invention is not to be considered as restricted thereto. It will be easily understood by those skilled in the art that other variations and modifications can be made within the scope of this invention as claimed.

What is claimed is:

1. In an article storage and dispensing device for a vending machine including a cabinet for storing articles having a loading opening and a discharge opening, a helical element extending vertically within said cabinet defining a plurality of article storage spaces, a driving source connected to the upper end of said helical element for successively discharging the stored articles, and a detecting plate for confirming whether articles are still stored on said helical element, said plate extending vertically within said cabinet and being pivotally supported on said cabinet, the improvement comprising, a movable element extending vertically within said cabinet and movably supported on said cabinet, said movable element being disposed in a clearance space between a wall of said cabinet and said detecting plate while articles are still stored in said cabinet, said movable element being operatively connected with said driving source through a motion transmitting mechanism to effect swinging motion of said movable element, and said movable element having a projection thereon for pushing said detecting plate when said movable element is swung.

2. The article storage and dispensing device of claim 1 wherein said movement transmitting mechanism comprises a horizontal extending portion which is formed integral with said movable element and biased to a rest position by a spring element, and a pin element projects from said driving source for engagement with said horizontally extending portion when said helical element is rotated.

3. The article storage and dispensing device of claim 2 wherein said horizontally extending portion is limited in its swing angle by a stopper projecting inwardly from an inner surface of a wall of said cabinet.

4. An article storage and dispensing device for a vending machine comprising:

a cabinet composed of two side plates, rear plate, front plate and top plate to form a storage space for articles, said front plate having a front opening for loading articles into said cabinet and a lower end opening for successively discharging the articles;

a helical element vertically extending within said storage space of said cabinet defining a plurality of article storing spaces;

a driving source mounted on said top plate including a drive motor and coupling element for connecting the upper end of said helical element to said drive motor to enable rotating motion to be applied to said helical element for discharging the stored articles;

a sold out indicating device including a detecting plate which extends vertically within said storage space of said cabinet, said detecting plate being pivotally supported on said cabinet;

an empty switch mounted on said cabinet to be controlled by movement of said detecting plate; and means for moving said detecting plate while said driving motor is operating comprising a vertical rod extending along an inner surface of said rear plate and swingably supported on said rear plate, a horizontal rod integrally formed with said vertical rod and engaged with a spring element to bias said vertical and horizontal rods, and a pin element projecting from said coupling element, said pin element engaging with said horizontal rod when said drive motor is operating.

5. The article storage and dispensing device of claim 4 wherein said vertical rod has at least one shaft element horizontally projecting therefrom, said shaft element extending loosely through a hole formed in said rear plate to swingably support said vertical rod.

6. The article storage and dispensing device of claim 4 wherein said pin element comprises a pin connecting said coupling member and said helical element.

7. The article storage and dispensing device of claim 4 wherein said vertical rod has at least one projection which normally contacts with said detecting plate to apply swinging motion to said detecting plate.

* * * * *